United States Patent [19]

Dailey

[11] Patent Number: 4,766,832

[45] Date of Patent: Aug. 30, 1988

[54] BEADED-LUFF FREE FLYING SAIL FOR A BOAT

[76] Inventor: Kevin S. Dailey, 65 Summit Dr., Smithtown, N.Y. 11788

[21] Appl. No.: 62,124

[22] Filed: Jun. 12, 1987

[51] Int. Cl.[4] ..... B63H 9/04

[52] U.S. Cl. ..... 114/103

[58] Field of Search ..... 114/102-105, 114/39, 39.1

[56] References Cited

U.S. PATENT DOCUMENTS

| | | | |
|---|---|---|---|
| 2,565,219 | 8/1951 | Gardiner et al. | 114/103 |
| 3,459,149 | 8/1969 | Hallmark | 114/103 |
| 3,759,210 | 9/1973 | Davis | 114/105 |

*Primary Examiner*—Sherman D. Basinger
*Assistant Examiner*—Jesûs D. Sotelo
*Attorney, Agent, or Firm*—Frishauf, Holtz, Goodman & Woodward

[57] ABSTRACT

A bead formed of a cylindrical flexible cylindrical strand of round contour, for example of foam rubber, is fastened along the luffs of a spinnaker by means of a tape which wraps around a flexible elastic core and is stitched to the edge of the sailcloth portion of the sail to hold the bead in place. A spinnaker so equipped with luff beading has been found able to sail closer to the wind than a sail not so equipped, by an average 2° to 5° and is also less critical with respect to overall trim at other pointing angles when reaching.

13 Claims, 2 Drawing Sheets

FIG. 4
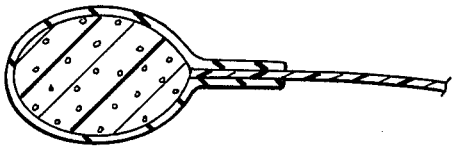
FIG. 5
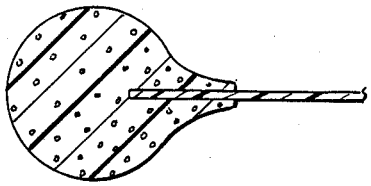
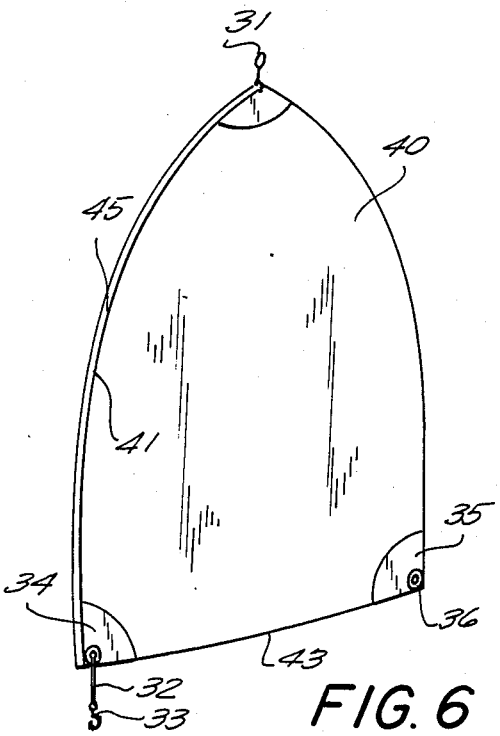
FIG. 6
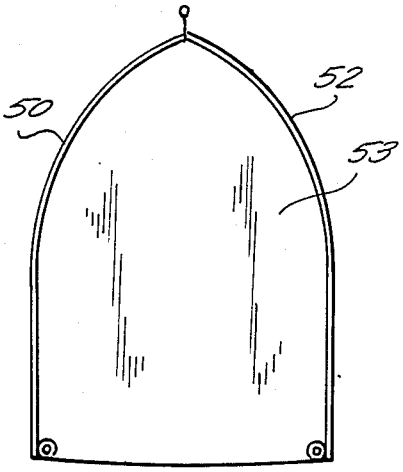
FIG. 7

BEADED-LUFF FREE FLYING SAIL FOR A BOAT

This invention relates to free flying sails such as spinnakers and sails which are tacked down to the boat at one lower corner while the other lower corner is adjustably trimmed without the tacked-down lateral edge being hanked onto a stay or guided in a luff foil. A third corner is suspended from a mast; usually with a swivel fitting at the top of the sail.

Such sails are usually used for propelling the boat downwind or across the wind, as distiguished from going to windward with sails close-hauled, and they are usually made of lighter material than so-called working sails which are also used close-hauled.

One of the problems of sailing with a spinnaker or with a free flying reacher (the latter being tacked down with the luff being otherwise unconstrained) is that when a boat is steered on a course which has a considerable crosswind component of direction, the edge of the sail to windward with respect to cross-boat component of the wind is unstable. This instability is aggravated by the fact that spinnakers are cut with curved luffs to provide a large surface and a generous sail curvature aloft. Free-flying reachers are likewise designed with curved luffs so as to let the wind increase the sail area and curvature aloft. So long as the angle of attack of the apparent wind at the edge of the sail is a sufficiently large angle, the sail keeps its desired arched shape, but when that angle of attack becomes small, the leading edge of the sail tends to "curl" and even collapse. It is then difficult to manipulate the guy and the sheet, in the case of a spinnaker, or just the sheet in the case of a reacher, in a manner that will reestablish the desired sail shape and it may be necessary for the helmsman to steer the boat somewhat more downwind than the desired course, in order to reestablish proper air flow at the spinnaker or free-flying reacher. This is so even though the edge of the sail may be somewhat stiffened, in the conventional way, by a protective edge tape folded around the edge of the sail cloth.

SUMMARY OF THE INVENTION

It is an object of the present invention to provide a free flying sail capable of being used in reaching across the wind without then being prone to instability and collapse at the windward edge for small angles of attack of the apparent wind.

Briefly, a flexible bead of mostly or substantially round cross section is attached on at least one edge of the sail leading down from the sail head—both edges of the sail in the case of a spinnaker, for at least a major part of the length of that sail edge. In case of the bead not running along the entire length of the sail edge from the head to one of the lower corners, it is important to have the bead run substantially along the lower two thirds of the sail edge. The bead can conveniently be a cylindrical strand of flexible foam material, in which case it can be stitched to the sail by a cloth or plastic tape cover. The most suitable thickness of the bead appears to depend upon the size of the sail and conditions of use. Its surprising stabilizing effect of the sail has been found on small test sails used indoors with artificial wind for test purposes even when the bead has a diameter as small as 5 mm. For a sail to be set from a mast 10 or 15 meters above the water, the bead thickness of 20 mm appears to be suitable, and more generally between 12 mm and 25 mm. For larger sails, bead thickness up to 50 mm may be expected to be suitable, but is is not expected that optimal bead thickness would increase as much as proportionally to linear sail dimensions. It may be that apparent wind velocity has an influence on the optimal bead thickness. That would have to be taken into account in the design of spinnakers for use in winds of 20 knots or more.

It appears that the function of the bead does not depend upon a mere flexible stiffening of the sail edge, but rather mainly upon aerodynamic properties of the beaded edge.

When a test sail was fitted with the foam bead luff of the invention and compared with another sail of identical weight and shape without the foam bead luff, using a constant direction of air flow and an angle grid to measure the close-hauling ability of the two sails, it was found that the sail fitted with beaded luff was able to sail closer to wind than the sail without the beaded luff, on the average 2° to 5° closer. The sail with foam bead luff was also less critical to overall trim while used at the same pointing angle as the comparison sail, relative to the apparent wind. Furthermore, if the sail with the beaded luff was allowed to curl, it would instantly refill. This was evidently due to the bead re-attaching the air flow to the inner side of the sail. The sail with no bead along the luff did not refill under similar conditions.

In the case of a spinnaker, the presence of a bead on the leeward edge of the sail when reaching across the wind does not appear to create any substantial loss of pull of the sail, at least compared with a similar sail that has no bead along either luff.

It is recognized that headsails that are supported on a stay by means of a headfoil or with the interposition of roller furling gear are provided with a luff bead for holding the luff of the headsail in the luff grove and thus giving it the stiffness of the stay support, which is important for going to windward and helpful for close reaching. Such sails are cut with relatively straight luffs that are designed to be pulled straight in use and are practically never set flying (i.e., without the stay support). Furthermore, such headsails usually have more thickness or stiffness of material near the luff than is the case with spinnakers and reachers and the beads are very small for the size of the sail. A headsail, such as an inner head sail, that might be intended to be set "flying" (so as to be easily removable to clear the foretriangle) would normally be provided with a wire luff which would be pulled tight in use and provide a great deal of stiffness, but no perceptible aerodynamic stabilizing effect.

It is also known to wrap the forward edge of a sail around a mast, as is done particularly for sailboards, but of course a sail with its luff running along a mast does not have any problem of "curling" that luff or collapsing it in the way a spinnaker luff often does for lack of a spar or stay to position the luff along its length. So far as the aerodynamic effect of a mast is concerned, the problem there has been that the mast is so thick that the aerodynamic disturbances are undesirable rather than helpful. Efforts have accordingly been made rather to reduce the thickness of the mast rather than to increase it, or else to provide additional bodies to swing around the mast axis to give a streamline or "wing mast" effect. In the present case, no special shaping of the contour of the bead near the sail is necessary, although it may be convenient to give the bead an oval cross section lined up with adjacent part of the sail, or to fair off the cross section near the sail, or even to provdide a slot for the sail when the bead is molded with flanges so that it can be stitched to a sail edge in such a slot, assuming that the bead can be made in such a way as to be tough enough to hold the threads of the stitches.

The importance of being able to use a spinnaker, or the kind of reacher with a spinnaker-like head, a few degrees closer to the wind than is possible with the conventional unbeaded sail edges is a substantial advantage for racing, since it makes possible more use of a light sail of large area when the wind strength is appropriate for the use of such a sail. There is also an advantage for cruising sailboats that the spinnaker or reacher will require a great deal less attention from the crew during a reach, thus encouraging its use for the enjoyment of the extra speed it can provide even when there is complete absence of speed competition with other sailboats.

BRIEF DESCRIPTION OF THE DRAWINGS

The invention is further described by way of illustrative example with reference to the annexed drawing, in which:

FIG. 4 is a cross-section showing a first modification of FIG. 2;

FIG. 5 is a cross-section showing a second modification of FIG. 2;

FIG. 6 is a plan view similar to FIG. 1 of a multipurpose reacher sail according to the invention, and FIG. 7 is a modified embodiment of a spinnaker according to the invention shown in the same manner as the spinnaker of FIG. 1.

DESCRIPTION OF THE ILLUSTRATED EMBODIMENTS

Figure 1:
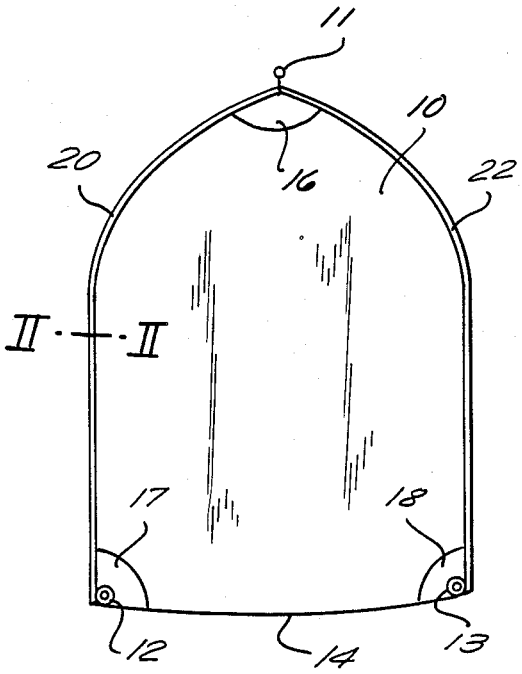
FIG. 1 is a plan view of a spinnaker according to the invention as it would appear if laid out on a sailmaker's floor.

FIG. 1 shows a spinnaker for a sailboat made of the usual light sailcloth, which is ½ oz. or ¾ oz. nylon, in the conventional shape, as it appears when laid out flat. The course of the seams and other details of the construction of the sail are not shown, since these are well known for a variety of ways of constructing a spinnaker out of strips of sail cloth. At the head of the sail end is the usual swivel fitting for attaching the spinnaker halyard by which the sail is suspended in use from a suitable point of the boat's mast. Grommet-type cringles 12 and 13 are provided at the other corners of the sail for attachment of lines serving respectively as guy and sheet. The foot 14 of the sail has the conventional hem or taped edging (not shown) to protect the edge of the sail from tearing during handling. The head of the sail 10 is provided with the usual reinforcement for its corners, where stress concentrates, as shown at 16 for the head and at 17 and 18 for the clews. Since a spinnaker can be set with the wind having a component flowing across it from either of its side edges, its lateral edges leading up to the head fitting 11 are both called luffs. Since the lower corners are both connected to lines (a pole being connected to one of the lines, rather than to one of the sail corners, normally), both of the lower corners are referred to as clews.

Figure 2:
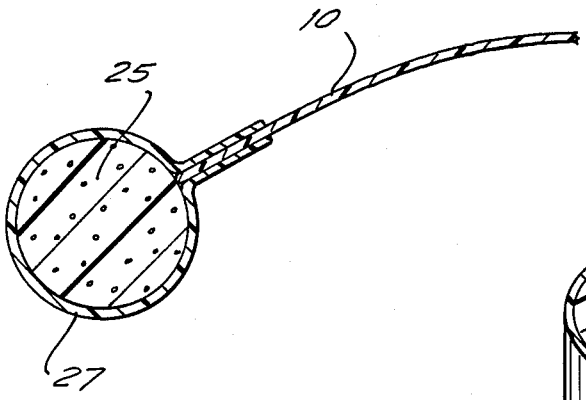
FIG. 2 is a cross section of a portion of the spinnaker of FIG. 1 in the neighborhood of one of the luffs, as for example as indicated at the lines II—II of FIG. 1.

Both of the luffs of the spinnaker of FIG. 1 are provided with beads 20 and 22 fastened to the remainder of the sail 10 in a manner shown in FIG. 2.

The beads 20 and 22 join at the place where the head swivel is attached to the head of the sail. It is not necessary that the two need to be joined one to another there, so long as they are both fastened to the sail at a location adjacent to the head fitting or its cringle (not shown). In fact, as will be further explained with reference to FIG. 7, it is possible to obtain advantages of the invention while leaving some parts of the luffs unbeaded, so long as an extensive portion of the middle length of the luffs is beaded. Preferably, the entire luff length is beaded as shown in FIG. 1.

Figure 3:
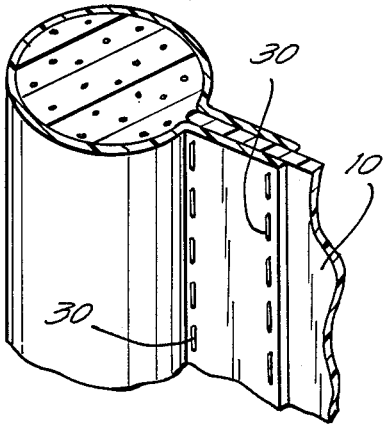
FIG. 3 is a perspective view of a part of the spinnaker of portions shown in FIG. 2.

The luff bead according to the invention which is shown in FIG. 2 has a flexible cylindrical cord 25 made of foam rubber or of a flexible foamed synthetic resin such as flexible polyurethane foam or flexible PVC foam, for example. Foam type flexible materials are preferred because low specific gravity material promotes responsiveness to aerodynamic forces for a given size of bead. Around the core 25 is wrapped a cloth tape between the edges of which the edge of the sailcloth portion of the sail 10 is inserted. As shown in FIG. 3, stitching 30 (not shown in FIG. 2) pinches the tape 27 snugly around the core 25 and also attaches it to the edge of the sailcloth of the sail 10. A plastic film tape, for example "Mylar" could be used instead of a cloth tape, and could be attached to the sailcloth by heat sealing but at present a cloth tape, for example of nylon cloth, is preferred.

FIG. 4 shows a bead of oval shape attached to the sail in the same manner as in FIG. 2. FIG. 5 shows another possible modification of FIG. 2, in this case a bead with fillets extending on both sides of the sail. The sail can be fastened into the bead slot by means of an adhesive.

FIG. 6 shows a sail that may be described as a multipurpose reacher, because it can act something like a spinnaker when set "wing in wing" with the boat's mainsail, s well as being able to function as a reacher.

It has a swivel fitting 31 at the head and it has a tack pennant 32, usually made of wire and fitted with a snap shackle 33, for connecting the tack 34 of the sail to a suitable eye on or near the bow of the boat. The clew of the sail is shown at 35 with its cringle 36. The sailcloth portion 40 of the sail is asymmetrical in that the luff 41 is shorter than the leech 42.

Along the luff, in accordance with the invention, a bead 45 is provided in the manner shown in FIGS. 2 and 3 for the spinnaker of FIG. 1. The leech, 42, like the foot 43, has only the usual hem or flat tape edging.

FIG. 7 illustrates that it is not necessary, in order to obtain some substantial advantage from the invention, for the luff-beading to run along the entire length of the luff. In FIG. 7 the beading is omitted for short length of each luff of a spinnaker, near the head of the sail, as shown by the luff beads 50 and 52 attached to the sailcloth portion 53 of the sail. It is believed that the beading in the portion of the sail that arches out away from the chord between the head and the windward clew of a spinnaker or the tack of a reacher has the more important role in the stabilizing of the windward edge of the sail in reaching, but it also appears to be important that the bead should extend both above and below the portion where its presence has the greatest aerodynamic effect, in order to transmit the responsive forces of the sail as modified by the presence of the luff bead, from the portions of the sail that respond more quickly to stabilizing forces to those that respond more slowly, for whatever reason. Thus, even though in the more inherently stable portions of the sail near the top or bottom of the sail the luff bead could be omitted without loss of some considerable advantage from the presence of the bead on the remainder of the luff, it is preferred for the bead to run along substantially the full length of the luff.

Although the invention has been described by reference to particular illustrative examples it will be understood that variations and modifications are possible within the inventive concept.

I claim:

1. A convexly triangular sail for a sailing craft, for setting with fastening to the rig only at the corners of the sail with suspension of the said aloft from a sail head corner while normally permitting the edges of the sail extending from said head corner respectively to two lower corners to maintain a convexly curved shape increasing the effective sail area aloft, said sail being further characterized in that:

the sail edge between the sail head corner and at least one of said lower corners is provided, over a major part of the length of said sail edge, with a flexible bead attached thereto so as to extend along said edge of the sail, said bead being of a cross section which is round in shape at least for the surfaces of the bead respectively facing in directions away from and transversely to adjacent surfaces of the sail when the sail is set.

2. A sail according to claim 1, wherein only one of the edges of the sail which meet at the sail head, which one edge serves as the only luff of the sail, is provided with a said bead, whereby when said sail is used as a reacher or as a multi-purpose light sail, said luff is free to vary its shape, by virtue of the flexibility of said bead, according to the effects of wind and of trimming the lower corner of the sail which is remote from said luff, by a line attached to said lower corner.

3. A sail according to claim 2, wherein said bead extends along substantially the entire length of said luff edge.

4. A sail according to claim 2, wherein said bead extends along said luff edge for at least the lower two thirds of the length of said luff edge.

5. A sail according to claim 2, wherein said bead is of substantially round cross-section.

6. A sail according to claim 5, wherein said bead is attached to said sail luff by a covering web passing around the bead and stitched to the sail luff.

7. A sail according to claim 2, wherein said bead is attached to said sail luff by a covering web passing around the bead and stitched to the sail luff.

8. A spinnaker for a sailboat having sail head for suspension from a mast and two clews for attachment of trimming lines and a shape, when spread flat, of a convex triangle as the result of the luffs of the sail bowing out convexly to provide additional sail area for the upper part of the sail, said spinnaker being further characterized in that:

said spinnaker luffs are each provided, over a major part of the length of the luff, with a flexible bead attached thereto extending along the luff of the sail, said bead being of a cross section which is round in shape at least for the surfaces of the bead respectively facing in directions away from and transversely to adjacent surfaces of the sail when the sail is set.

9. A spinnaker according to claim 8, wherein each said bead is of substantially round cross-section.

10. A spinnaker according to claim 9, wherein each sail bead is attached to said sail luff by a covering web passing around the bead and stitched to the sail luff.

11. A spinnaker according to claim 8, wherein each said bead is attached to said sail luff by a covering web passing around the bead and stitched to the sail luff.

12. A spinnaker according to claim 8, wherein said beads on the luffs of the sail each extend along substantially the full length of the luff.

13. A spinnaker according to claim 8, wherein said beads extend along portions of said respective luffs to which they are attached for at least the lower two thirds of the lengths of said respective luffs.

* * * * *

UNITED STATES PATENT AND TRADEMARK OFFICE

CERTIFICATE OF CORRECTION

PATENT NO. : 4,766,832

DATED : August 30, 1988

INVENTOR(S) : Kevin S. DAILEY

It is certified that error appears in the above-identified patent and that said Letters Patent is hereby corrected as shown below:

COLUMN 5, Claim 1, line 15, "said" should be -- sail --.

COLUMN 6, Claim 10, line 30, "sail" should be -- said --.

Signed and Sealed this

Twenty-eighth Day of November 1989

*Attest:*

JEFFREY M. SAMUELS

*Attesting Officer* *Acting Commissioner of Patents and Trademarks*